US009428718B2

(12) United States Patent
Hensley

(10) Patent No.: US 9,428,718 B2
(45) Date of Patent: Aug. 30, 2016

(54) LIQUID MIXTURE TO CLEAN DIELECTRIC BARRIER DISCHARGE SURFACES

(75) Inventor: Paul F. Hensley, Moorestown, NJ (US)

(73) Assignee: IONFIELD HOLDINGS, LLC, Moorestown, NJ (US)

( * ) Notice: Subject to any disclaimer, the term of this patent is extended or adjusted under 35 U.S.C. 154(b) by 506 days.

(21) Appl. No.: 13/381,411

(22) PCT Filed: Jun. 29, 2010

(86) PCT No.: PCT/US2010/040461

§ 371 (c)(1),
(2), (4) Date: Feb. 3, 2012

(87) PCT Pub. No.: WO2011/002801

PCT Pub. Date: Jan. 6, 2011

(65) Prior Publication Data

US 2012/0149621 A1 Jun. 14, 2012

Related U.S. Application Data

(60) Provisional application No. 61/221,795, filed on Jun. 30, 2009.

(51) Int. Cl.

| | |
|---|---|
| ***C11D 11/00*** | (2006.01) |
| ***C11D 3/43*** | (2006.01) |
| ***C11D 7/50*** | (2006.01) |

(52) U.S. Cl.

CPC ..... *C11D 11/0047* (2013.01); *C11D 3/43* (2013.01); *C11D 7/5022* (2013.01)

(58) Field of Classification Search

CPC ..... C11D 1/62; C11D 3/48; C11D 1/72; C11D 3/2068; C11D 3/43; C11D 1/90

USPC ..... 510/342, 365, 417, 504

See application file for complete search history.

(56) References Cited

U.S. PATENT DOCUMENTS

| | | | | |
|---|---|---|---|---|
| 5,629,280 | A * | 5/1997 | Richter et al. | 510/463 |
| 6,323,171 | B1 * | 11/2001 | Fonsny et al. | 510/384 |
| 7,070,951 | B2 * | 7/2006 | Zhang et al. | 435/40.52 |
| 7,618,931 | B1 * | 11/2009 | Scheuing et al. | 510/340 |
| 7,659,237 | B2 * | 2/2010 | Baldridge et al. | 510/280 |
| 2003/0030030 | A1 | 2/2003 | Sahbari | |
| 2003/0073600 | A1 * | 4/2003 | Avery et al. | 510/382 |
| 2004/0162230 | A1 * | 8/2004 | Jenevein et al. | 510/504 |
| 2005/0277572 | A1 * | 12/2005 | Heise et al. | 510/501 |
| 2006/0100125 | A1 * | 5/2006 | Horton, III | 510/421 |
| 2006/0115973 | A1 | 6/2006 | Seki et al. | |
| 2006/0270583 | A1 * | 11/2006 | Baldridge et al. | 510/392 |
| 2008/0171685 | A1 * | 7/2008 | Cobb et al. | 510/433 |
| 2009/0018050 | A1 * | 1/2009 | Peters | 510/492 |
| 2009/0304608 | A1 * | 12/2009 | Cueman et al. | 424/53 |
| 2010/0029519 | A1 | 2/2010 | Schwab et al. | |
| 2010/0160200 | A1 | 6/2010 | Seki et al. | |

FOREIGN PATENT DOCUMENTS

| | | |
|---|---|---|
| WO | 2009058278 | 5/2009 |

OTHER PUBLICATIONS

Clark et al., "Why are dimethyl sulfoxide and dimethyl sulfone such good solvents?" Journal of Molecular Modeling, vol. 14, No. 8., pp. 689-697, May 6, 2008.

* cited by examiner

*Primary Examiner* — Gregory Webb
(74) *Attorney, Agent, or Firm* — Maldjian Law Group LLC

(57) ABSTRACT

Disclosed is a liquid cleaning mixture used to remove DMSO and other solvents and compounds that may build up on the surface of dielectric barrier material in a plasma cleaning device, where the DMSO, solvent and compounds have become contaminants.

4 Claims, No Drawings

LIQUID MIXTURE TO CLEAN DIELECTRIC BARRIER DISCHARGE SURFACES

This application is a national phase filing under 35 U.S.C. §371 of international patent application number PCT/US10/040461 filed Jun. 29, 2010 which claims priority to U.S. Provisional Application Ser. No. 61/221,795 filed Jun. 30, 2009, each of which is hereby incorporated by reference in its entirety.

This application claims benefit of priority to U.S. provisional patent application No. 61/221,795 filed on Jun. 30, 2009, which is hereby incorporated by reference in its entirety.

BACKGROUND OF THE INVENTION

The present invention relates to a liquid mixture used to remove DMSO and other solvents and compounds that may build up on the surface of dielectric barrier material.

Dielectric barrier discharge plasma devices can be used to create ozone and ionic cascades used for cleaning and sterilization. In some instances, solvents and compounds on the item being so treated include DMSO, other solvents and/or compounds that are partially or not ionized at all by the plasma. This un-ionized material will in some instances condense on the dielectric barrier material or alternatively splash on the dielectric barrier material due to imparted force from the plasma field or simply drop off the item onto the dielectric barrier surface.

The presence of these solvents and compounds on the surface of the dielectric barrier material may alter the properties of the energy release from the surface of the dielectric barrier material. Specifically it is known that solvents and compounds can form a layer on top of the dielectric barrier material and alter the optimum frequency of the energy release or that other solvents and compounds can change the amount of energy required to achieve energy release from the dielectric barrier material. In some instances, solvents and compounds due to a mix being on the surface can effect both a change in optimum frequency and the amount of energy required to achieve energy release from the dielectric barrier material.

SUMMARY OF THE INVENTION

Some embodiments of the invention provide a liquid cleaning mixture comprising an aqueous phase comprising at least one cleaning agent, surfactant, solubilizer, detergent or combination thereof; and an organic phase comprising an organic solvent selected for dissolving contaminants; wherein the aqueous phase and the organic phase are miscible in one another.

In some embodiments, the contaminants comprise at least one of solvents, DMSO, biological matter, unknown sample materials, and organic compounds.

In some embodiments, the surfactants are selected from ionic and anionic surfactants such as those based on sulfate, sulfonate or carboxylate, quaternary ammonium anions, amphoteric, and combinations thereof.

In some embodiments, the organic phase comprises a solvent selected from denatured alcohol, ethanol or methanol.

In some embodiments, the aqueous phase makes up from about 1% to about 99% of the mixture.

In some embodiments, the ratio of aqueous phase to organic phase is dependent upon the temperature where higher temperatures yield higher ratio of aqueous portion. In some embodiments, the aqueous portion is present at about 10% to about 40%. In some embodiments, the aqueous portion is about 12.5 to about 25%.

Some embodiments of the invention provide a liquid cleaning mixture comprising:

an aqueous phase comprising:
about 95.5% water,
about 1% 2-butoxyethanol;
about 1% 2-hexoxyethanol; and
about 2.5% isopropyl alcohol;

and an organic phase comprising:
denatured alcohol.

In some embodiments, the ratio of aqueous phase to organic phase is about 1:6, in some further embodiments, the ratio is about 1:3.

In some embodiments, the liquid cleaning mixture is suitable for use at about 20-25° C.

In some embodiments, the aqueous phase is about 90% to about 99.75% water.

In some embodiments, the cleaning agent is one or more C1-C6 alkoxyethanol or combinations thereof.

DETAILED DESCRIPTION OF THE INVENTION

Plasma generating devices can be used in a variety of applications, including those used to clean surfaces. The descriptions herein are directed to the exemplary use of a plasma generator for cleaning tips used in the pharmaceutical industry for moving specific amounts of test materials to an array of sample wells. One such device is Ionfield's TipCharger. In this setting, it is important to clean the tips to prevent cross-contamination and for good lab hygiene. In these situations, the dissolved test product is usually an unknown, but dissolved in a solvent, such as DMSO. During the plasma cleaning process, the solvent DMSO and any product or other compounds remaining on the tips can be splattered on the dielectric barriers within the plasma cleaning device, hindering its optimal performance, the solvent and other materials therefore, become contaminants and must be cleaned periodically. The liquid mixtures described herein are particularly well suited for the task.

The liquid mixture comprises: (1) an aqueous phase optionally with one or more cleaning agents which may include substances that are surfactants, solubilizers or detergents or combinations thereof; and (2) an organic phase, selected for being highly effective dissolving the contaminant, compound or compounds on the surface of the dielectric barrier material. The two phases are preferably miscible in the proportions used. The ratio of the mixture will depend upon the temperature of the dielectric barrier material.

In some embodiments, the aqueous phase may simply be water. In some such embodiments, a preferred organic phase is simply an alcohol, such as denatured alcohol. In some embodiments, additional cleaning agents, surfactants, solubilizers, detergents, combinations and other ingredients may be used.

Many suitable cleaning agents can be used. As will be appreciated by those of skill in the art, many will span definitions of surfactants, solubilizers and detergents. Some suitable cleaning agents include $C_1$-$C_6$ alkoxyethanols such as 2-butoxyethanol and 2-hexoxyethanol, and combinations thereof. Such compounds are known cleaning agents which act as solvents, solubilizers, and/or surfactants.

The use of surfactants accelerates the process of solubilizing DMSO and other solvents (that is, it accelerates the process of making the previous solvent become a solute).

Once the DMSO (or other solvent) is a solute, either by a mechanism of simple dilution or as emulsion by the surfactant, the liquid can volatilize and in that process remove the DMSO.

DMSO is a common solvent used particularly in the pharmaceutical industry. DMSO is a polar aprotic solvent that all types of surfactants will emulsify, some more effectively than others, as is known to those practiced in this field. As a result any ionic and nonionic surfactant is suitable for use in the liquid cleaning mixtures described herein.

Specific examples of Ionic surfactants include but are not limited to those based on sulfate, sulfonate or carboxylate, specific examples include SDS, SLES, and fatty acid salts. Also, those based on quaternary ammonium anions, specific examples include but are not limited to benzalkonium chloride, benzethonium chloride and cetylpyridinium chloride. Also those based on amphoteric, specific examples include but are not limited to dodecyl betaine, and cocamidopropyl betaine.

Specific examples of Nonionic surfactants include but are not limited to those based on polysorbates, Alkylphenol poly(ethylene oxide), Poloxamers (or Poloxamines), Alkyl polyglucosides, Fatty alcohols, Cocamide MEA and cocamide DEA, Dodecyl dimethylamine oxide. Specific example of Nonionic surfactants include but are not limited to the Tween series, Triton X, Octyl glucoside, Oleyl alcohol and dodecyl dimethylamine oxide.

Detergents are useful because they include surfactants as well as wetting agents that further accelerate the transition of DMSO and other solvent into solutes. Detergents also help with classic biology applications, such as dealing with cell membranes and proteins which may become contaminants depending upon the application. Accordingly, detergents can be quite useful when used in biological or biotechnology applications. Sometimes tips to be cleaned have cells and/or cellular materials on them. In that case some of that material can be in the splattered DMSO and thus onto the dielectric barrier. This cellular material naturally move into the alcohol aqueous mixture disclosed herein. The detergent facilitates this step, and thus facilitates cleaning. SDS, SLES, Tweens, Triton X X100, X114, CHAPS, DOC, NP-40, and Octyl-ThioGlucosides, and others are suitable detergents. The distinction between surfactants and detergents is often unclear, and those of skill in the art will readily recognize that several detergents may also be useful as detergents and several detergents are also useful as surfactants.

Any suitable solubilizer may be used depending upon the contaminants expected. In many instances, the contaminant is unknown, and therefore a specific solubilizer will not be known, and a general solubilizer may be employed. In some instances, the use of a surfactant and/or a detergent will compensate for lack of a solubilizer specific to a contaminant.

The aqueous phase increases proportionally with temperature to retard evaporation, ranging from a low of about 1% at low temperatures to about 99% at high temperatures at which the organic solvent would reach its flash point. For example, a low temperature may be anything above DMSO's melting point 18.5 degrees C. (approximately 65.3 degrees F.) to a high temperature of 300 degrees C. The amount of aqueous content should increase as the operating temperature increases so as to control the rate of volatility of the organic phase. At 80 to 100 degrees F., usual operating temperature, about 10 to about 20% aqueous phase for optimum effectiveness but other ratios from about 2% to about 50% aqueous phase also provide acceptable effectiveness. In the highest temperature, the ratio can be as high as 98% aqueous.

The ratio of the mix may be limited because the proportions in any embodiment must remain miscible. In some embodiments, the percentage of aqueous phase ranges from about 10% to about 40%. In other embodiments, the percentage of aqueous phase ranges from about 12.5 to about 25%.

The organic phase can employ any solvent that DMSO (or other solvent to be cleaned) is soluble in, that will not react with the solvent to be cleaned, and will volatilize at the operating temperature of the DB. In some embodiments, the solvent to be cleaned is highly soluble in the chosen organic phase. Denatured alcohol, $C_1$-$C_6$ alcohols, particularly ethanol or methanol can be used. The organic portion should also be miscible in the aqueous phase. Denatured alcohol and water are miscible in virtually any ratios and therefore are suitable for use herein.

In one embodiment, the aqueous phase comprises about 95.5% water, about 1% 2Butoxyethanol, about 1% 2-hexoxyethanol, and about 2.5% Isopropyl Alcohol; and the organic phase comprises an undyed denatured alcohol. In this embodiment, the mix was about 1 part aqueous phase to about 6 parts organic phase.

In another embodiment using the same two starting phases, a mix of about 1 part aqueous phase with about 3 parts organic phase may be to be used with a dielectric barrier material operating at about 20 to about 25 degrees Celsius higher temperature than the temperature of the dielectric barrier material in the prior embodiment.

In other embodiments, the aqueous phase may have other chemicals including surfactants, ammonia, and ethanol compounds knows to those practiced in these arts. In the aqueous phase, the percentage of each chemical compound may range from about 0.25% to about 10.0% with the remaining percentages preferably being water.

In other embodiments, the organic phase can be any solvent, miscible with the aqueous phase, that dissolves the contaminant solvent(s) or contaminant compound(s) on the dielectric barrier material surface. Other common organic solvents, either non-polar, polar protic or polar aprotic include, but are not limited to: isopropanol, methanol, benzene, toluene, n-butanol, acetic acid, formic acid.

An application where the invention may be useful includes restoring the plasma generating characteristics in a dielectric barrier discharge (DBD) application and/or other applications having an exposed dielectric material.

Embodiments of the present invention offer several benefits and advantages over other methods of cleaning exposed dielectric material. For example, it has been demonstrated that a liquid mixture in accordance with an embodiment of the present invention may be dropped into a TipCharger device while it is running and in 10-30 seconds the liquid mixture helps to clean off any DMSO on a plate.

In a pipette tip cleaning device such as the TipCharger device (http://ionfieldsystems.com/tipcharger), an array of dielectric barrier members is arranged in a planar format resembling a microtitre plate format, allowing an array of microtitre tips to be treated between adjacent dielectric barrier members. In such an arrangement, the dielectric barrier members can be cleaned without disassembling the unit and manually scrubbing each member by simply introducing an effective amount (about 1 uL in the 384 format, 4 uL in the 96 format and 10 uL in the 8 channel format) into the device while it is running. The solution may be delivered by filling the tips of the tip array with an amount of the solution. By employing small amounts over the entire tip array, full even dispersement of the solution across the entire dielectric barrier array is easily accomplished. Alternatively, the liquid mixture could be introduced separate alongside the tips or item to be cleaned. In yet another alternative, the liquid mixture could be introduced in to the plasma generator in the absence of an item to be cleaned. In yet another alternative, and potentially when deeper cleaning is required, the device could be disassembled and manually sprayed with the solution with a suitable applicator device, (similar to a WaterPick). The device could then be reassembled, or manually clean e.g. with a device similar to a cotton swab wetted with the liquid cleaning mixture. Regular maintenance by introducing the solution to the running machine, however, should eliminate the need for such manual deep cleanings, or at least reduce their frequency, thereby saving down time.

Similar application techniques can be used in any device using a dielectric barrier.

It is contemplated that in high volume operations such as those in the pharmaceutical area, that the step of cleaning the dielectric barrier could be incorporated into routine methods, perhaps running a cleaning cycle after a fixed amount of cycles to avoid build up of contaminants on the dielectric barrier. In such instances, dosing is easily facilitated simply by picking up a liquid mixture for cleaning the dielectric barriers as described herein, rather than sample material, and directing the tips to the plasma rather than a sample plate. In an alternative embodiment, the liquid mixture could be introduced into the tips from above, avoiding the need for picking up cleaning liquid mixture. For example, a cleaning cycle could automatically imitate after a set number of tip cleaning cycles, for example after 10 cycles, after 20 cycles, or any desired number. The frequency could depend upon a number of factors, including the type of contaminants known or expected.

Of course, the liquid cleaning mixture described herein could be used in more traditional cleaning methods where the devices is partially or completely disassembled or otherwise manually cleaned using the liquid mixture described rather than conventional cleaners.

The only other ways to clean the plates are: (1) to disassemble the TipCharger and scrub the plates with a Q-tip type device dipped in denatured alcohol; or (2) drip in solvent, a solvent like denatured alcohol, into a running TipCharger device for 10 to 15 minutes while heating to over 200 degrees C. As one skilled in the art would appreciate, shedding the thermal energy so that the TipCharger device would not melt plastic pipet tips is a major drawback since it takes a great deal of time. Benefits of the approach disclosed herein are speed (e.g., 15 to 30 times faster), ease of use, and no heat buildup.

While the description above describes that the solution can be used to simply remove the DMSO/compounds from the dielectric barrier, it could also be used to pre-treat the pipetting tips before going into the plasma to facilitate cleaning of the tips themselves.

There has been a long-felt need in the industry and lots of money has been spent doing research to solve this problem. The fixes developed to date have not been completely successful or adopted in the industry for various reasons. For example, the procedure of heating at high temperature for a period of time, as described above, was not totally unacceptable to do in a lab. Although there has been a recognized need for a solution to deal with DMSO and plasma in the context of a dielectric barrier discharge application, no one has suggested this idea.

What is claimed is:

1. A liquid cleaning mixture comprising:

an aqueous phase comprising:

about 95.5% water, about 1% 2-butoxyethanol;

about 1% 2-hexoxyethanol; and about 2.5% isopropyl alcohol;

an organic phase comprising:

denatured alcohol.

2. The liquid cleaning mixture of claim 1 wherein the ration of aqueous phase to organic phase is about 1:6.

3. The liquid cleaning mixture of claim 1, wherein the ratio of aqueous phase to organic phase is about 1:3.

4. The liquid cleaning mixture of claim 3 wherein said mixture is suitable for use at about 20-25degrees Celsius.

* * * * *